US008157109B2

(12) United States Patent
Zu

(10) Patent No.: US 8,157,109 B2
(45) Date of Patent: Apr. 17, 2012

(54) MOUNTABLE STORAGE APPARATUS WITH RETRACTABLE LINKING MECHANISM AND METHOD

(75) Inventor: Runner Zu, Foshan (CN)

(73) Assignee: Deflecto, LLC, Indianapolis, IN (US)

( * ) Notice: Subject to any disclaimer, the term of this patent is extended or adjusted under 35 U.S.C. 154(b) by 708 days.

(21) Appl. No.: 11/955,173

(22) Filed: Dec. 12, 2007

(65) Prior Publication Data

US 2010/0038330 A1 Feb. 18, 2010

(51) Int. Cl.
*A47F 7/14* (2006.01)

(52) U.S. Cl. ..... 211/55

(58) Field of Classification Search ..... 211/55, 211/52, 113, 118, 45, 106.01, 181.1; 24/545, 24/546, 565; 248/220.22, 302, 316.7
See application file for complete search history.

(56) References Cited

U.S. PATENT DOCUMENTS

| | | | | | |
|---|---|---|---|---|---|
| 2,112,925 | A * | 4/1938 | Ostler | 40/124 |
| 3,234,616 | A * | 2/1966 | Wantland | 24/543 |
| 4,083,456 | A * | 4/1978 | Genn et al. | 211/55 |
| 4,162,014 | A * | 7/1979 | Bobrick | 211/50 |
| 4,613,047 | A * | 9/1986 | Bushyhead et al. | 211/55 |
| 4,696,081 | A * | 9/1987 | Yen | 24/558 |
| 5,009,335 | A * | 4/1991 | Jonker | 211/55 |
| 5,184,737 | A * | 2/1993 | Hardy | 211/55 |
| 5,222,609 | A * | 6/1993 | Eaton | 211/55 |
| 5,344,030 | A * | 9/1994 | Evenson | 211/55 |
| 5,823,359 | A * | 10/1998 | Harris et al. | 211/11 |
| 6,016,926 | A * | 1/2000 | Smith et al. | 211/119.011 |
| 6,092,672 | A * | 7/2000 | Harris et al. | 211/11 |
| 6,226,840 | B1 * | 5/2001 | Lu | 24/67.5 |
| 6,412,648 | B1 * | 7/2002 | Woolnough et al. | 211/128.1 |
| 6,422,403 | B1 * | 7/2002 | Woolnough et al. | 211/55 |
| 7,712,641 | B2 * | 5/2010 | Snyder | 223/88 |
| 7,730,593 | B1 * | 6/2010 | Juilly | 24/67.5 |
| 2002/0030028 | A1 * | 3/2002 | Isserstedt | 211/113 |
| 2006/0016772 | A1 * | 1/2006 | Plzak | 211/70.6 |

* cited by examiner

*Primary Examiner* — Jennifer E. Novosad
(74) *Attorney, Agent, or Firm* — SNR Denton US LLP; Brian R. McGinley; Anne K. W. Sutton

(57) ABSTRACT

An apparatus and method for organizing, storing, and/or filing items, with a primary receptacle that is mountable to a wall and supports additional receptacles via attachment to and suspension from a hook that is pivotally attached to a bottom of the primary receptacle.

10 Claims, 5 Drawing Sheets

MOUNTABLE STORAGE APPARATUS WITH RETRACTABLE LINKING MECHANISM AND METHOD

BACKGROUND OF THE INVENTION

The present inventive concept relates generally to an apparatus and method of organizing documents and other tangible items, and more particularly, to an apparatus and a method comprising a wall-mounted receptacle capable of supporting additional receptacles thereon.

SUMMARY OF THE INVENTION

The present invention relates to a novel apparatus and method for organizing, storing or filing items including, for example, a substrate, office supplies and/or other tangible articles in one or more hanging receptacles or the like. The apparatus comprises a primary receptacle which may be mounted, for example, to a surface such as the wall of a room, cubicle, or the like. The primary receptacle may then accommodate or support one or more additional receptacles via attachment to and suspension from a attachment mechanism (e.g., a hook) that is pivotally attached to a bottom of the primary receptacle. Additional receptacles may then be successively attached in series or parallel in like fashion. While each additional receptacle may or may not be secured to the wall for additional support, a primary object of the present general inventive concept is to provide a filing apparatus having a primary receptacle that may easily accept additional units depending on a desired application of the filing apparatus, thereby increasing versatility. The retractable attachment mechanism allows adaptability and flexibility for use of the apparatus in a variety of spaces also provides aesthetically pleasing appearance, increased safety, and ease and efficiency for packaging, and shipping and storing the apparatus.

A principal object of the present general inventive concept is to provide a method and system to organize items in one or more receptacles situated on a wall so that files therein may be easily indentified without requiring manual manipulation of the files.

Another object of the present general inventive concept is to provide a method and system to organize files in a first receptacle unit that supports additional receptacle units each arranged successivly and depending one from another.

Another object of the present general inventive concept to provide a method and system to organize files, the system having a first receptacle unit to support additional receptacle units so that only the first receptacle requires securing to a wall.

Another another object of the present general inventive concept to provide a simple low-cost system to organize files and/or individual papers and for separating such files and/or papers into defined areas for easy identification and removal.

Another another object of the present general inventive concept to provide a system to organize files having a number of receptacles that are efficiently designed with a front side, left and right sides, and a partial rear side that is supplemented in part by the wall.

Another another object of the present general inventive concept to provide a system to organize files having a number of units each having a receptacle that is efficiently designed with a front side, left and right sides, and a partial rear side that is supplemented in part by the wall to form the receptacle.

Another another object of the present general inventive concept to provide a system to organize files having a number of units with each unit being identical and self-contained so that each unit may hang from or be hung from each other.

The foregoing and other objects are intended to be illustrative of the present general inventive concept and are not meant in a limiting sense. Many possible embodiments of the present general inventive concept may be made and will be readily evident upon a study of the following specification and accompanying drawings comprising a part thereof. Various features and subcombinations of present general inventive concept may be employed without reference to other features and subcombinations. Other objects and advantages of this present general inventive concept will become apparent from the following description taken in connection with the accompanying drawings, wherein is set forth by way of illustration and example, an embodiment of this present general inventive concept and various features thereof.

BRIEF DESCRIPTION OF THE DRAWINGS

A preferred embodiment of the invention, illustrative of the best mode in which the applicant has contemplated applying the principles, is set forth in the following description and is shown in the drawings.

DETAILED DESCRIPTION OF THE PREFERRED EMBODIMENTS

Figure 1:
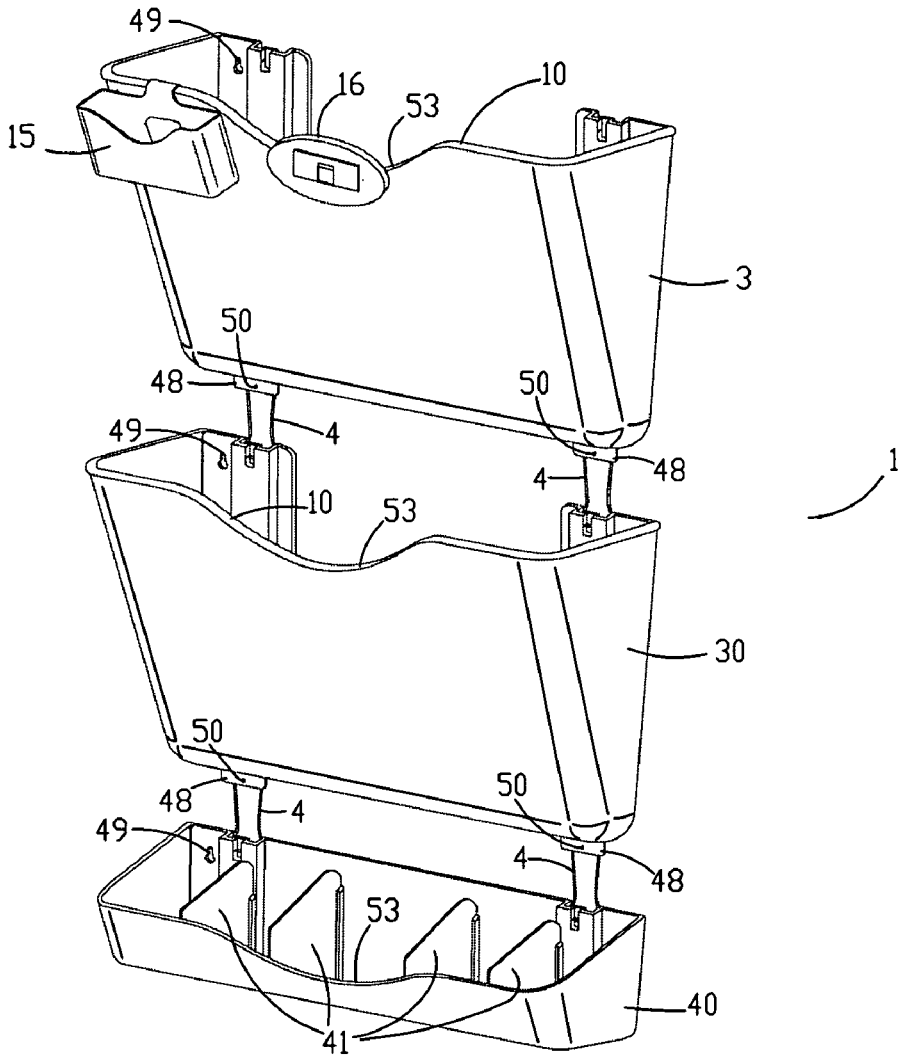
FIG. 1 is a perspective view of the filing system of the present general inventive concept illustrated in FIG. 1.
Figure 2:
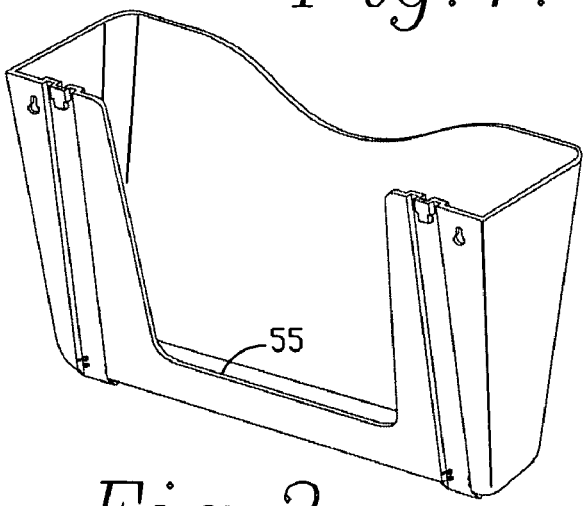
FIG. 2 is a rear perspective view of a single receptacle of the filing system of the present general inventive concept.
Figure 3:
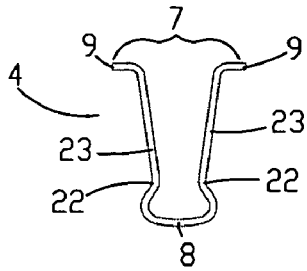
FIG. 3 is a front view of a hook of the present general inventive concept.
Figure 4:
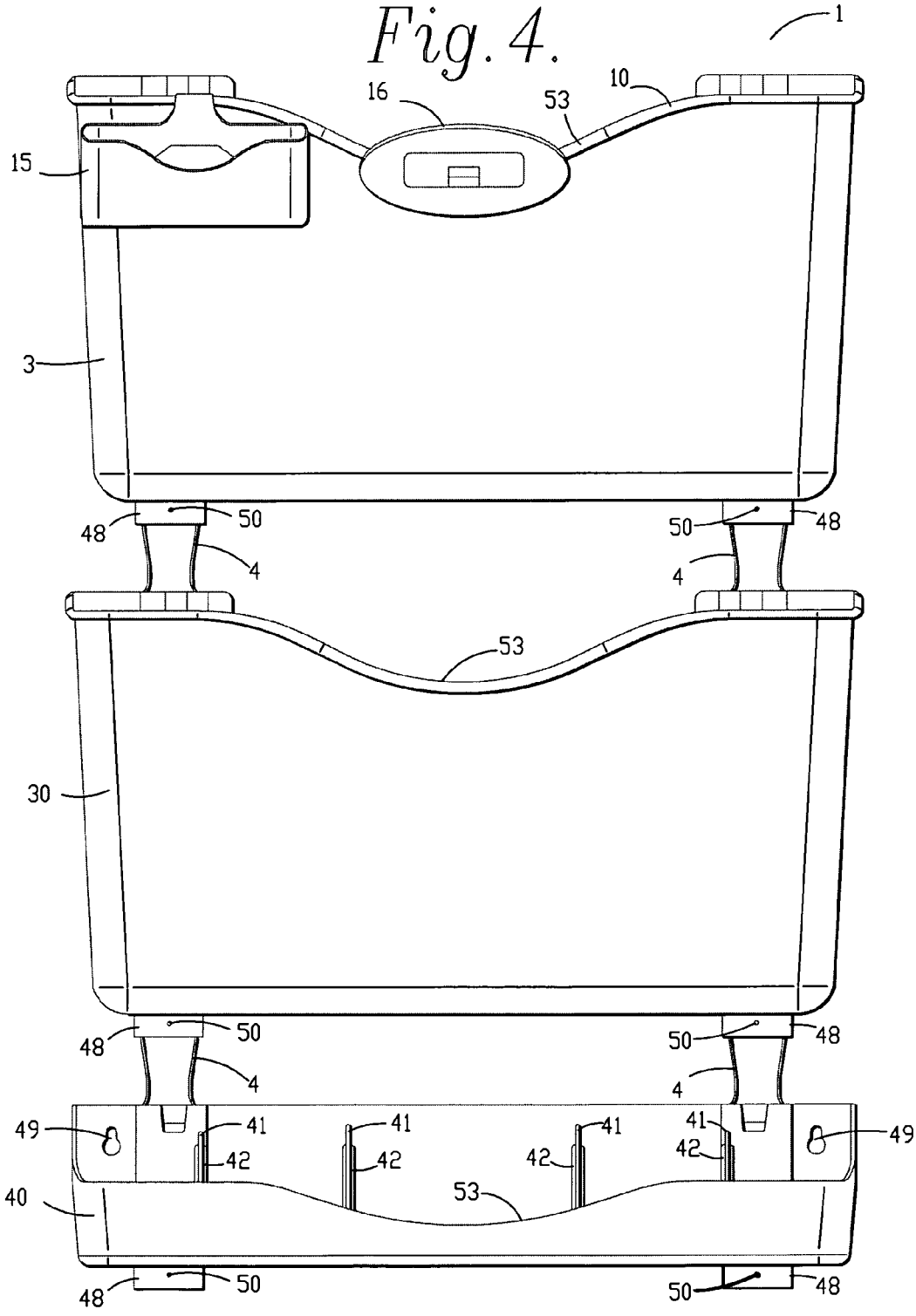
FIG. 4 is a front view of a mountable storage apparatus of the present general inventive concept illustrating an upper primary receptacle with a second identical receptacle attached to the primary receptacle, and an organizer receptacle attached to the second receptacle.
Figure 5:
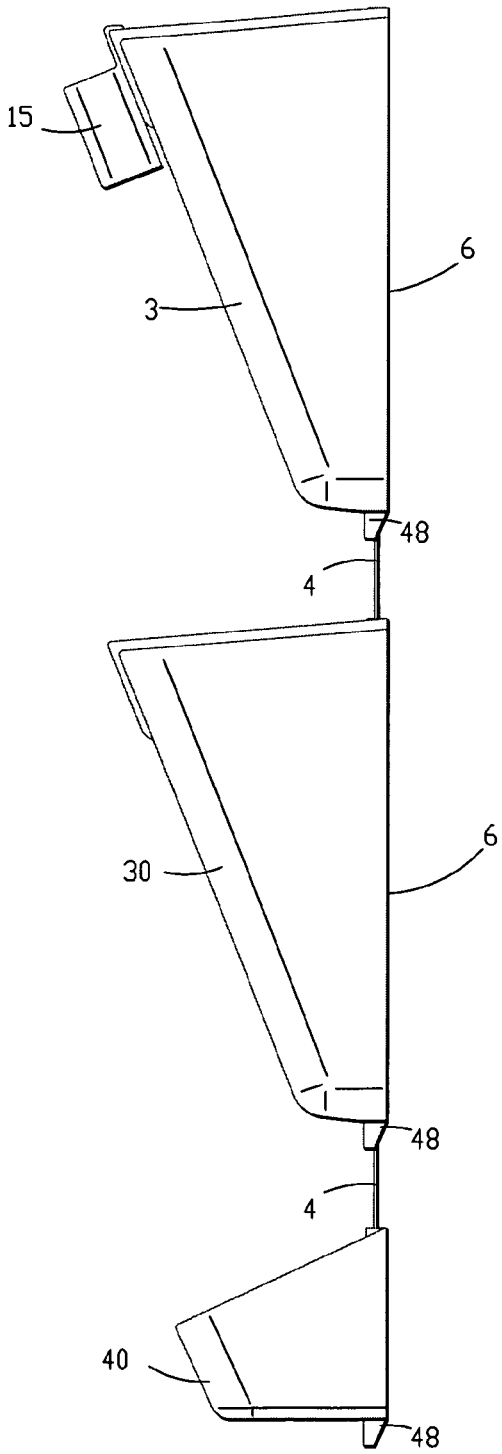
FIG. 5 is a side view of the filing system of the present general inventive concept illustrated in FIG. 1.
Figure 6:
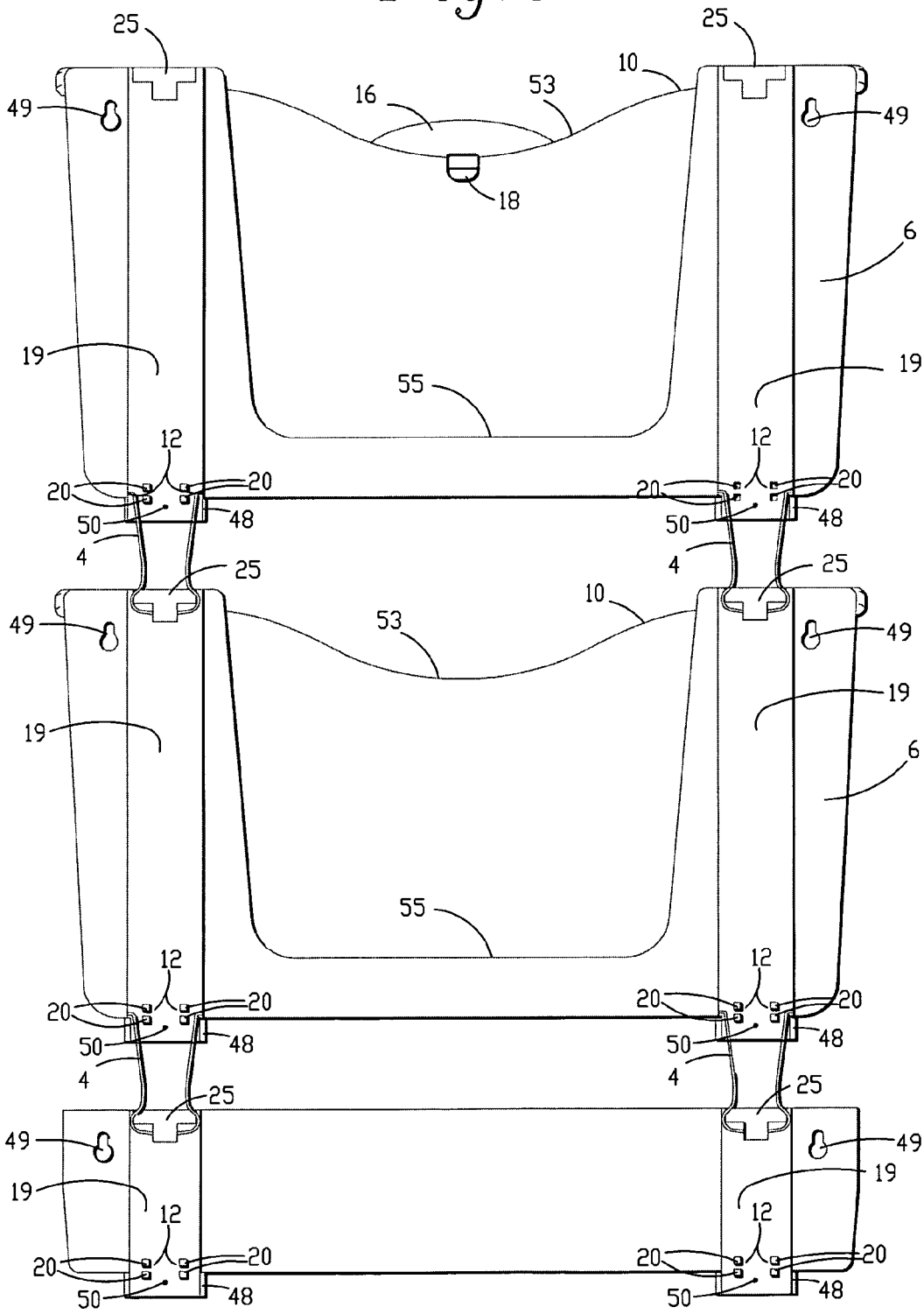
FIG. 6 is a rear view of the filing system of the present general inventive concept illustrated in FIG. 1 with a rear opening to abut a wall.
Figure 8:
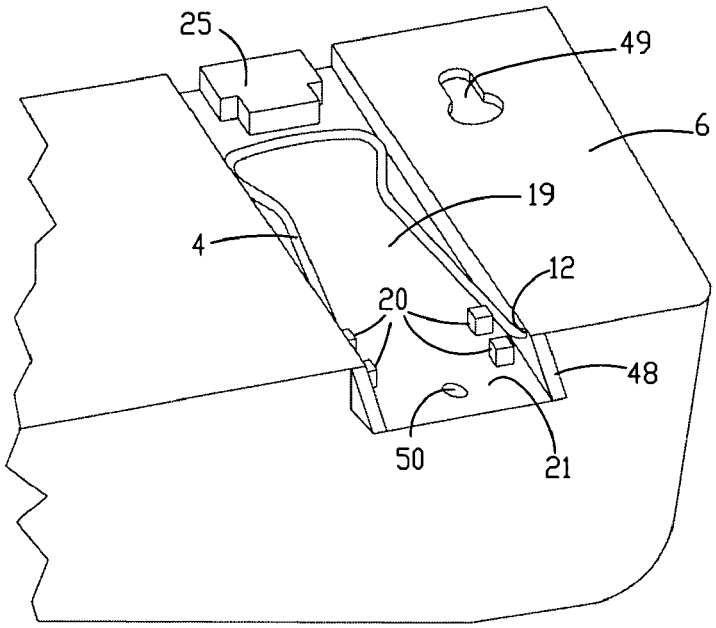
FIG. 8 is an illustration of the present general inventive concept showing an enlarged fragmentary view of an attachment hook thereof.
Figure 7:
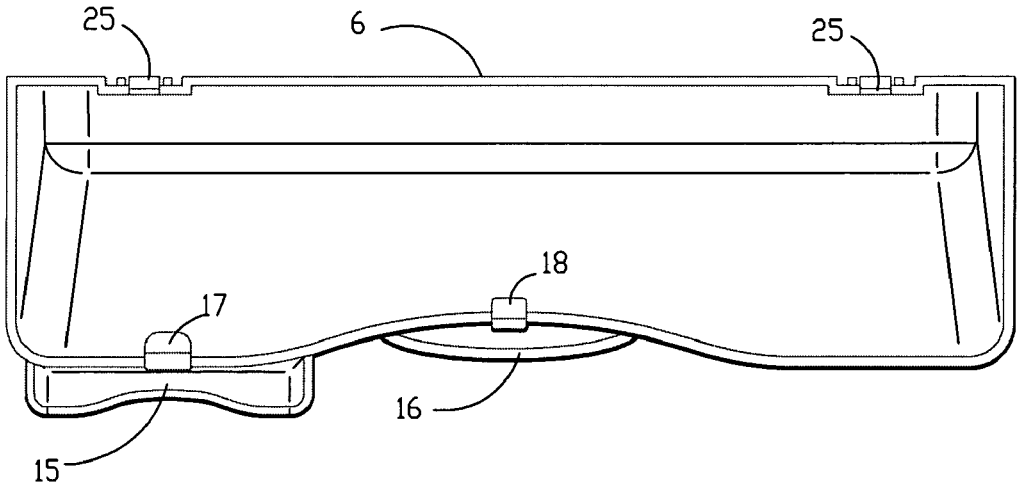
FIG. 7 is a top view of the filing system of the present general inventive concept illustrating an upper primary receptacle with an interior.

Reference will now be made in detail to the embodiments of the present general inventive concept, examples of which are illustrated in the accompanying drawings, wherein like reference numerals refer to the like elements throughout. The embodiments are described below in order to explain the present general inventive concept be referring to the figures.

According to the above objects, the present general inventive concept includes a wall-mounted filing system 1. In an exemplary embodiment, the filing system 1 is configured with a primary wall receptacle 3 having a generally rectangular shape. The wall receptacle 3 includes an upper lip 10 to support, for example, a business card holder 15 to hold standard business cards and/or other like-shaped objects. The business card holder 15 may be attached to the upper lip 10 via a hook 17 molded into a back of the business card holder 15.

A label holder 16 may also be attached to the upper lip 10 via a hook 18 molded into a back of the label holder 16 so that a user may indicate a type of use for the wall receptacle 3, e.g., if the wall receptacle 3 is used as a mailbox, a name can be assigned via the label holder 16. In the exemplary embodiment, the label holder 16 is oval and manufactured via two pieces of molded plastic with an opening that is approximately ⅛" slot located at the top of the holder 16 to receive and hold a piece of paper to allow the user to label the receptacle 3. Any depending wall receptacle 3 may have its own business card holder 15 and label holder 16.

Attached to either side of a lower end 5 of the primary wall receptacle 3 are two generally u-shaped hooks 4 having an open end 7 and a closed end 8. The open end 7 has laterally-extending points 9 that are sized and shaped to engage apertures 12 and permit rotation of the hook 4 upon engagement of the hook 4 with the receptacle 3.

The apertures 12 are located in either side of a groove 19 that extends from the lower end 5 of the wall receptacle 3 to the upper lip 10. The u-shaped hooks 4, once engaged within the apertures 12, may be selectively rotated up and down between an extended position (illustrated in FIG. 1) and a retracted position (illustrated in FIG. 15). When rotated downward to the extended position, the u-shaped hooks 4 are configured to receive a mating tab 25 from an additional receptacle 30 such that each of the hooks 4 that extend from the primary receptacle 3 provides support or a mounting attachment for the tab 25 of the additional receptacle 30. When rotated upward to the retracted position, the u-shaped hook 4 is in a collapsed or storage configuration, such that the hook 4 is effectively hidden behind the receptacle 3.

The u-shaped hooks 4 are made of a resilient material such as metal and have bends 22 in arms 23 to provide structural reinforcement of the u-shaped hooks and a degree of resiliency. The u-shaped hooks 4 engage the apertures 12 by pinching or compressing the hooks 4 at the arms 23, aligning the hook points 9 with the apertures 12, and releasing the hooks 4 so that the points 9 resiliently spring back or decompress to their original position, thereby entering the apertures 12.

Each groove 19 has four square projections 20 that extend out from a rear wall 21 of the groove 21. The projections 20 are arranged in two rows, an upper row and a lower row, each having two of the projections 20. The upper row is located slightly above the apertures 12 while the lower row is located slightly below the apertures 12. The projections 20 block and otherwise restrict flexing of the u-shaped hooks 4 when the u-shaped hooks 4 are in the storage or use configuration so as to prevent undesired disengagement of the hooks 4 with the apertures 12. The projections 20 permit flexing of the u-shaped hooks 4 only when the hooks 4 are rotated to a position that is precisely between the storage and use configuration (not illustrated) so that the u-shaped hooks 4 extend in a direction parallel to the projection direction of the projections 20 project out from the rear wall 21.

When the u-shaped hooks 4 are in the storage configuration, the u-shaped hooks rest inside the groove 19 so that a rear surface 6 of the wall receptacle 3 is generally flush to provide a planar rear surface 6 and thereby facilitate secure mounting of the wall receptacle 3 to a wall (not illustrated).

When the u-shaped hooks 4 are in the use configuration, the u-shaped hooks may be used to engage an additional receptacle 30. Specifically, each primary receptacle 3 and additional receptacle 30 are identically shaped and have a mounting tab 25 located in each groove 19 that is sized and shaped to receive the closed end 8 of the hook 4. The tab 25 extends outward from the rear of the wall receptacle 3 and has a downwardly-protruding point to partially surround and securely engage the closed end 8 of the hook 4.

The tab 25 is entirely contained within the groove 19 and is flush with the rear surface 6 of the wall receptacle 3 to provide a planar rear surface 6 and thereby facilitate secure mounting of the wall receptacle 3 to the wall.

Any number of additional receptacles 30 may be sequentially attached to each other with the primary limiting factors being space available on the wall and reach of the user required to gain access to the receptacles 3 and 30.

In the exemplary embodiment, the primary receptacle 3 is mounted to the wall, an additional receptacle 30 is attached to the first wall receptacle 3 via hooks 4, and an organizer 40 is attached to the second wall receptacle 3 via hooks 4. The additional receptacles 33 are interchangeable with the organizer 40 and may be arranged in any order depending on application, such as with the organizer 40 as the primary wall mount and the primary receptacle 3 depending therefrom.

In the exemplary embodiment, the organizer 40 is designed exactly the same as the receptacles 3 and 30, having hooks 4 in grooves 19 with mounting tabs 25 and having the same width as the receptacles 3 and 30, but the organizer 40 is approximately one-third as deep as the receptacles 3 and 30.

Additionally, the organizer 40 has four removable dividers 41 within an interior thereof, however, it is foreseen that any number of dividers can be used depending on application. The dividers 41 are easily installed via the user by sliding each divider 40 between laterally extending grooves 42 located on an interior of the front and rear surfaces. The dividers 41 have a bottom surface with via two tabs 43 that extend downward and into two tab-receiver apertures 44 in the organizer 40 bottom surface to further secure the dividers 40.

In the exemplary embodiment, the primary receptacle 3 is first mounted to the wall, however, the organizer 40 may also be first mounted. On either side of an upper portion of the groove 19 in the rear wall of both the wall receptacle 3 and organizer 40 are upper apertures 49. On the lower portion of the groove are tabs 48 having lower apertures 50. The apertures 49 and 50 may be used to mount the wall receptacle 3 and/or the organizer 40 to the wall via screws, nails, or the like.

While the lower apertures 50 are a secondary means of attachment and may not be used depending on the weight of items to be stored via the system 1, if the lower apertures 50 are to be used, the hooks 4 must be moved to either the use configuration or the storage configuration prior to using the lower apertures 50. After the lower apertures 50 are used to secure the wall receptacles 3 or 30, and/or organizer 40 to the wall, the hooks 4 cannot thereafter be rotated.

The wall receptacles 3 and 30, and/or the organizer 40 have a dip 53 in the upper lip 10 to permit easy access to any contents stored therein.

The wall receptacles 3 and 30 have an opening 55 in the rear wall 6, which requires less material and provides a system 1 with increased efficiency. Because the receptacles 3 and 30 abut a wall (not illustrated), which provides a rear surface, the wall receptacles 3 and 30 can be designed with only a partial rear wall 6.

The wall receptacles 3 and 30, and/or the organizer 40 may be manufactured in various shapes depending on application to accommodate various items While the exemplary embodiment provides hooks 4 that rotate on a horizontal axis and in two directions, i.e., up and down, it is foreseen that hooks may rotate on a vertical axis and from left to right to provide increased versatility in mounting of add-ons.

Further, while the exemplary embodiment provides a vertical stacking of receptacles, it is foreseen that receptacles may extend horizontally or horizontally and vertically along a wall. In this embodiment, hooks or other like attachment means may be situated on one side or both sides of a primary receptacle to support additional receptacles on either side of the primary receptacle. The additional receptacles may also support further additional receptacles.

Having now described the features, discoveries and principles of the general inventive concept, the manner in which the general inventive concept is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the general inventive concept herein described, and all statements of the scope of the general inventive concept which, as a matter of language, might be said to fall therebetween.

What is claimed is:

1. A mountable storage apparatus comprising:

a first receptacle having a bottom and an opening for receiving an item;

a connector mounted to the bottom, the connector being moveable between a first extended position and a second collapsed position, wherein, the connector in a first extended position is rotated downward from the bottom of the first receptacle such that the connector in the first extended position is capable of supporting a second receptacle, the connector in the second collapsed position is rotated upward to the bottom of the first receptacle such that the connector in the second collapsed position is effectively hidden behind the first receptacle, a connector open end on a top portion of the connector, the connector open end configured to engage the first receptacle, and a connector closed end located opposite of the connector open end, the connector closed end configured to engage the second receptacle.

2. The mountable storage apparatus of claim 1, wherein the connector open end engages the first receptacle via resilient points that flex to engage the first receptacle.

3. The mountable storage apparatus of claim 2, further comprising: a plurality of points extending from a rear of the first receptacle to prevent flexing of the resilient points when the connector is in either the first extended position or the second collapsed position.

4. The mountable storage apparatus of claim 1, further comprising:

the second receptacle attached to the connector via a mounting tab, the mounting tab projecting from a rear of the second receptacle to engage the connector closed end.

5. The mountable storage apparatus of claim 1, further comprising: a tab extending from the bottom of the first receptacle to restrict rotation of the connector.

6. The mountable storage apparatus of claim 1, further comprising: a plurality of points extending from a rear of the first receptacle to prevent inadvertent disengagement of the connector from the first receptacle.

7. The mountable storage apparatus of claim 1, further comprising: a plurality of points extending from a rear of the first receptacle to only permit disengagement of the connector when the connector is at a predefined orientation with respect to the first receptacle.

8. The mountable storage apparatus of claim 7, wherein the predefined orientation is at an angle exactly between the first extended position and the second collapsed position.

9. The mountable storage apparatus of claim 1, further comprising: a label holder for labeling of the receptacle; and a hook to allow the label holder to hang from a lip on the first receptacle.

10. The mountable storage apparatus of claim 1, further comprising: a business card holder having a hook to engage a lip on the first receptacle.

* * * * *